US011794938B2

(12) United States Patent
Yourist et al.

(10) Patent No.: US 11,794,938 B2
(45) Date of Patent: Oct. 24, 2023

(54) CONTAINER FINISH HAVING IMPROVED RIM PLANARITY

(71) Applicant: GRAHAM PACKAGING COMPANY, L.P., Lancaster, PA (US)

(72) Inventors: Sheldon E. Yourist, York, PA (US); Michael J. Kelly, Round Mountain, TX (US); David B. Heisner, York, PA (US)

(73) Assignee: GRAHAM PACKAGING COMPANY, L.P., Lancaster, PA (US)

( * ) Notice: Subject to any disclaimer, the term of this patent is extended or adjusted under 35 U.S.C. 154(b) by 34 days.

(21) Appl. No.: 17/465,299

(22) Filed: Sep. 2, 2021

(65) Prior Publication Data

US 2023/0064902 A1 Mar. 2, 2023

(51) Int. Cl.

| | |
|---|---|
| ***B65D 1/02*** | (2006.01) |
| ***B65D 23/10*** | (2006.01) |
| ***B65D 53/04*** | (2006.01) |

(52) U.S. Cl.

CPC ..... *B65D 1/0246* (2013.01); *B65D 23/102* (2013.01); *B65D 53/04* (2013.01); *B65D 2501/0081* (2013.01)

(58) Field of Classification Search

CPC ..... B65D 1/0215; B65D 1/0246; B65D 2501/0027; B65D 23/102; B65D 53/04;

(Continued)

(56) References Cited

U.S. PATENT DOCUMENTS 3,999,677 A * 12/1976 Oberkircher ..... B65D 43/0256 220/784

4,006,837 A * 2/1977 Gates ..... B65D 41/0471 220/293

(Continued)

FOREIGN PATENT DOCUMENTS

| | | |
|---|---|---|
| EP | 0469777 B1 | 3/1994 |
| GB | 541710 A | 12/1941 |

OTHER PUBLICATIONS

International Search Report and Written Opinion dated Dec. 20, 2022 by the European Patent Office acting in its capacity as International Searching Authority of counterpart International Patent Application No. PCT/US2022/042329.

*Primary Examiner* — Steven A. Reynolds

*Assistant Examiner* — Prince Pal

(74) *Attorney, Agent, or Firm* — Armstrong Teasdale LLP

(57) ABSTRACT

A reinforced plastic container having improved rim planarity. The container has a non-round main body portion integral with a finish portion. The main body portion has a central longitudinal axis and defines a hollow interior of the container. The finish portion has an upper surface defining a rim with a circumference framing a round opening that provides access to the hollow interior of the container, a radially outwardly extending snap bead being adapted to receive and retain a closure and hermetically seal the container and including interrupted portions located around the circumference of the rim, and a plurality of reinforcements located in the interrupted portions of the snap bead and assuring substantial planarity of the upper surface of the rim even when substantial forces act on the container. Each reinforcement has a strut bounded by and centered between a pair of strut indents, with each indent supported by a buttress.

18 Claims, 10 Drawing Sheets

(58) Field of Classification Search
CPC ..... B65D 2501/0081; B65D 1/0223; B65D 2501/0036; B65D 1/023; B65D 41/0471; B65D 41/04; B65D 41/0485; B65D 41/28; B65D 41/30; B65D 1/10; B65D 43/0212; B65D 2543/00972
USPC ..... 215/42, 44, 40, 331, 330
See application file for complete search history.

(56) References Cited

U.S. PATENT DOCUMENTS 4,156,491 A * 5/1979 Lyon ..... B65D 41/0485 81/3.4
4,157,762 A * 6/1979 Robinson ..... B65D 43/0212 220/DIG. 13
D378,494 S * 3/1997 Miller ..... D9/528
5,642,825 A * 7/1997 Wohlgemuth ..... B65D 41/47 215/901
5,862,935 A * 1/1999 Dubois ..... B65D 1/46 220/326
5,887,739 A * 3/1999 Prevot ..... B65D 1/023 215/382
D420,593 S * 2/2000 Denner ..... D9/557
6,471,909 B1 10/2002 Czesak
D474,115 S * 5/2003 Walsh ..... D9/532
6,585,124 B2 * 7/2003 Boyd ..... B65D 1/10 220/675
6,648,157 B2 11/2003 Shai et al.
D482,974 S * 12/2003 Nottingham ..... D9/531
6,817,473 B2 * 11/2004 Schwaikert ..... B65D 1/0223 206/508
D504,823 S * 5/2005 Nottingham ..... D9/575
7,207,451 B2 4/2007 Taylor et al.
7,731,050 B2 * 6/2010 Parks ..... B65D 43/0212 220/780
D639,172 S * 6/2011 Dupuis ..... D9/531
D639,173 S * 6/2011 Dupuis ..... D9/531
8,025,176 B2 * 9/2011 Little ..... B65D 25/2897 220/DIG. 13
8,047,390 B2 * 11/2011 Strasser ..... B65D 1/0223 215/381
8,056,724 B2 * 11/2011 Estep ..... B65D 23/085 215/230
8,286,815 B2 * 10/2012 Thierjung ..... B65D 43/0212 215/398
8,313,005 B2 * 11/2012 Scarola ..... B65D 23/102 215/396
8,535,599 B1 9/2013 Lobbestael et al.
8,544,663 B2 10/2013 Barel et al.
8,556,621 B2 10/2013 Sequeira
8,585,392 B2 11/2013 Barnes
8,602,237 B2 12/2013 Wurster et al.
8,632,867 B2 1/2014 Young et al.
8,636,944 B2 1/2014 Kelley et al.
8,807,360 B2 * 8/2014 Erspamer ..... B65D 41/3428 220/276
D722,885 S * 2/2015 Mooney ..... D9/563
9,108,757 B2 * 8/2015 Paredes ..... B65D 23/06
9,174,759 B2 * 11/2015 Yourist ..... B65D 1/20
9,511,890 B2 * 12/2016 Gill ..... B65D 1/10
10,154,718 B2 * 12/2018 Salciarini ..... A45D 40/222
10,279,975 B2 * 5/2019 Soehnlen ..... B65D 41/04
10,526,117 B2 * 1/2020 Huss ..... B65D 21/0231
11,254,463 B1 * 2/2022 Kissinger ..... B65D 1/16
2002/0134747 A1 * 9/2002 Babcock ..... B65D 1/023 215/252
2002/0195471 A1 * 12/2002 Nottingham ..... B01F 35/42 206/508
2003/0230545 A1 * 12/2003 Mount ..... B65D 23/10 220/606
2004/0011825 A1 * 1/2004 McLelland ..... B65D 25/2897 222/465.1
2004/0195199 A1 * 10/2004 Maki ..... B65D 1/0223 215/381
2005/0077282 A1 * 4/2005 Keller ..... B65D 23/00 219/401
2007/0007232 A1 * 1/2007 Manera ..... B65D 1/0246 215/222
2007/0012650 A1 * 1/2007 Eble ..... B65D 1/0223 215/382
2007/0170144 A1 * 7/2007 Lane ..... B65D 1/0223 215/383
2007/0187412 A1 * 8/2007 Gruskin ..... B65D 1/10 220/500
2007/0187413 A1 * 8/2007 Gruskin ..... B65D 1/46 220/500
2007/0187420 A1 * 8/2007 Gruskin ..... B65D 25/2897 220/771
2007/0284331 A1 * 12/2007 Miota ..... B65B 7/285 215/331
2008/0093332 A1 * 4/2008 Little ..... B65D 23/102 220/770
2008/0156819 A1 * 7/2008 Scarola ..... B65D 25/2897 220/771
2008/0230505 A1 * 9/2008 Kerman ..... B65D 41/0471 215/44
2009/0266783 A1 * 10/2009 Eble ..... B65D 41/04 215/44
2010/0183777 A1 * 7/2010 Sagy ..... B65D 51/20 426/118
2010/0308044 A1 * 12/2010 Perry ..... B65D 41/56 220/200
2011/0000869 A1 * 1/2011 Braun ..... B65D 1/023 215/40
2012/0031871 A1 * 2/2012 Molinaro ..... B65D 1/0246 215/44
2012/0219734 A1 * 8/2012 Gill ..... B65D 1/10 428/34.1
2012/0325766 A1 * 12/2012 Boisvert ..... B65D 21/0204 215/10
2013/0092650 A1 * 4/2013 Ekkert ..... B65D 23/00 215/40
2014/0263339 A1 * 9/2014 Bates ..... B65D 41/0471 220/296
2014/0299567 A1 * 10/2014 Vogel ..... B65D 23/12 53/421
2015/0329232 A1 * 11/2015 Brozell ..... B65D 41/0471 215/44
2016/0031148 A1 * 2/2016 Hendrickson ..... B29C 33/42 425/436 R
2017/0021956 A1 * 1/2017 Ring ..... B65D 1/0207
2017/0029177 A1 * 2/2017 Holroyd ..... G01F 11/262
2017/0225843 A1 * 8/2017 Glaser ..... B65D 43/0277
2017/0341842 A1 * 11/2017 Sugizaki ..... B65D 1/0246
2018/0319556 A1 * 11/2018 Straughan ..... B65D 43/0212
2019/0061988 A1 * 2/2019 Liu ..... B65D 1/10
2019/0106238 A1 * 4/2019 Schriner ..... B65D 25/54
2019/0241330 A1 * 8/2019 Stoneberg ..... B65D 50/043
2020/0024022 A1 1/2020 Waltemyer et al.
2020/0180823 A1 * 6/2020 Murphy ..... B65D 43/0231
2021/0188475 A1 * 6/2021 Lefebure ..... B65D 1/0223
2022/0106088 A1 * 4/2022 Ludewig ..... B65D 53/04

* cited by examiner

PRIOR ART

PRIOR ART

CONTAINER FINISH HAVING IMPROVED RIM PLANARITY

TECHNICAL FIELD

The present disclosure relates generally to extrusion blow-molded plastic containers and, more particularly, to containers that include a non-round body, a round finish, and a reinforcement to assure rim planarity for seal integrity and enhance top load strength characteristics.

BACKGROUND

Many products that were previously packaged using metal or glass containers are now being supplied in plastic containers. Plastic containers are commonly used to store foodstuffs, medicine, liquids, and many other materials. Plastic containers are often used due to their durability, lightweight nature, and sustainability. A wide variety of suitable plastics are commercialized for various uses. For example, polyethylene terephthalate (PET) is often used to form containers that are lightweight, inexpensive, recyclable, and amenable to manufacture in large quantities.

Despite the advantages of plastic materials, however, metal and glass containers are still prevalent for certain products, particularly those that require a substantial amount of column or top load strength so that the structural integrity of the container is not compromised when the containers are stacked in boxes or pallets and subjected to substantial vertical compressive forces. In many plastic container designs, downward force applied to the finish portion may cause the upper surface or shoulder of the container to deflect downwardly and possibly buckle.

These containers must withstand a variety of external forces, such as radial side wall forces and axial top loading forces, during manufacture, packing, shipping, storage, and use. For example, containers are required to withstand radial forces during label application operations. As another example, containers filled using a hot fill process must be rigid enough to resist side wall collapse due to internal vacuums (which exert radial forces) that develop as the hot liquid cools after it is added to the container.

In addition to radial forces acting on the sides of a container, the container must also resist axial top load forces that act to compress a container. These forces arise at a variety of stages during the life cycle of a container: manufacture, fill, storage, transportation, display of containers for sales to consumers, and use by consumers. For one example, in blown plastic containers made by an extrusion blow molding process, it is common to form a retention mechanism on the finish by blow molding. The retention mechanism may comprise threads on the finish for engagement with threads on a closure. Where the retention mechanism comprises a blow molded bead on the container, the compressive axial force of application of a closure by closure application machinery can collapse the finish.

For a second example, top load forces also arise during capping operations. During capping, the container must resist not only collapse, but also deflection of the neck as the seal (e.g., cap) is applied. If the neck deflects during the capping operation, such that the rim is not planar, the seal will not be properly applied, leaving an opening or gap between seal and rim. This results undesirably both in scrap container material and in wasted product.

For a third example, containers may be stacked and stored after initial manufacture. Filled containers are packed in bulk in cardboard boxes, in plastic wrap, or in both.

Although individual containers may be relatively lightweight, the weight of multiple stacks of filled containers, as typically stored in a warehouse, is large, placing significant pressure on containers at or near the bottom of the stack. A bottom row of packed, filled containers may support several upper tiers of filled containers and, potentially, several upper boxes of filled containers. Therefore, it is important that the container have a top loading capability which is sufficient to prevent distortion from the intended container shape.

To help containers withstand the variety of external forces that they experience, conventional solutions have included the use of larger amounts of material. Increases in the amount of material (i.e., increases in "gram weight") are undesirable, however, because lightweighting of containers without a deterioration of physical properties can give a manufacturer a significant competitive advantage. Increases in gram weight may result in unacceptable increases in cost.

Therefore, plastic containers are continually being redesigned in an effort to reduce the amount of plastic required to make the container. In order to minimize material costs, it is desirable to make the container sidewall, as with the rest of the container, as thin as possible. Such lightweighting comes at the expense, however, of container strength and in particular column strength. Although there can be a savings with respect to material cost, the reduction of plastic can decrease container rigidity and structural integrity. Thus, a problem with plastic containers is that many forces act on, and alter, the as-designed shape of the container, particularly its dome configuration, from the time it is blow molded to the time it is placed on a shelf in a store.

U.S. Pat. No. 9,174,759 issued to the assignee of this application discloses a blow molded plastic container having improved top load strength. The disclosed container includes a main body portion having an upper surface and a finish portion that extends from the upper surface. A reinforcing strut is provided on the upper surface of the main body portion adjacent to the finish portion for providing increased structural rigidity and top load strength to the container. The reinforcing strut may be fabricated in a manner that promotes drainage of fluid from the container, such as by defining a downwardly sloping inner channel that leads to the finish portion when the container is inverted.

U.S. Pat. No. 9,511,890 issued to the assignee of this application discloses a rectangular blow molded plastic container that has improved resistance to deformation such as saddling. One problem that has persisted in the manufacture of containers is that the central portions of the upper rim tend to develop a concave shape, especially on the long sides of the container. This phenomenon is known as saddling, and it adversely affects the ability of a closure to form a good seal with the upper surface of the finish portion. The improved blow molded rectangular plastic container of the '890 patent exhibits superior resistance to saddling during the molding process.

There is a continuing need for container structures able to resist various forces that act on a container during manufacture, fill, storage, transportation, and use. The relative lack of focus on strengthening the neck region of plastic containers results in a particular need for designs that improve the rim planarity and the load resistance of this area, particularly in regard to sealing and/or capping operations and other manufacturing segments requiring top load strength. A need exists for a plastic container that can be manufactured using an extrusion blow molding process that exhibits superior rim planarity and column strength, particularly in the upper regions of the container that are adjacent to the finish portion. There is also a need for a blow molded plastic container having an improved reinforced rim which resists distortion due to processing, and resists compressive distortions due to top loading. A container having the planar rim should be capable of being made from a minimum of plastic to afford efficient manufacture.

SUMMARY

Accordingly, it is an object of the invention to provide a plastic container that can be manufactured using an extrusion blow molding process that exhibits superior rim planarity and column strength, particularly in the upper regions of the container that are adjacent to the finish portion. Another object is to provide a container capable of maintaining its structural integrity and aesthetic appearance despite the presence of distortion-inducing pressure. A further object is to provide a container having an improved planar rim with sufficient top loading capabilities to withstand the rigors of shipping and storage. A still further object is to provide a plastic, wide mouth container with a planar rim configuration that is relatively inexpensive to manufacture, structurally sound, and aesthetically appealing. It is another object to provide a blown plastic container having a finish sufficiently strong that it will not collapse when a closure is torqued or pressed onto the filled or unfilled container. Yet another object is to provide a container having a rim that supports consistently a seal assuring the security of contents stored in the container.

To achieve these and other objects, and in view of its purposes, the present disclosure provides a reinforced plastic container having improved rim planarity for seal integrity. The container has a non-round main body portion and a round or circumferential finish portion. The main body portion has a central longitudinal axis and defines a hollow interior of the container. The finish portion is integral with the main body portion and has an upper surface defining a rim with a circumference framing a round opening that provides access to the hollow interior of the container, a radially outwardly extending snap bead being adapted to receive and retain a closure and seal the container and including interrupted portions located around the circumference of the rim, and a plurality of reinforcements located in the interrupted portions of the snap bead and assuring substantial planarity of the upper surface of the rim even when substantial forces act on the container. Each reinforcement has a strut bounded by and centered between a pair of strut indents, with each indent supported by a buttress.

It is to be understood that both the foregoing general description and the following detailed description are exemplary, but are not restrictive, of the disclosure.

BRIEF DESCRIPTION OF THE DRAWING

The disclosure is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION

Figure 1A:
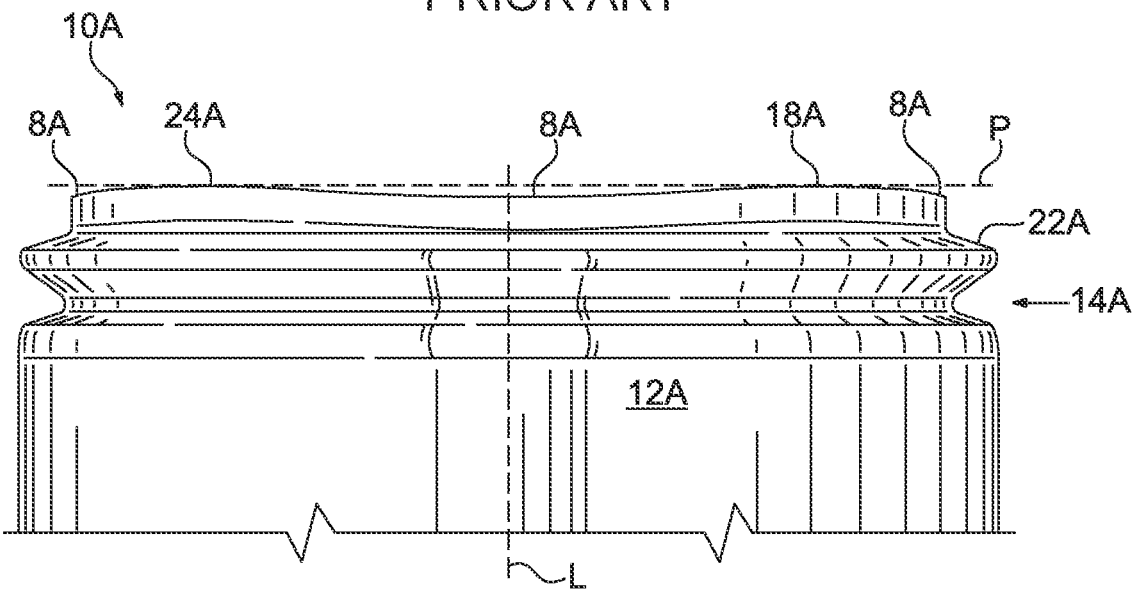
FIG. 1A PRIOR ART
FIG. 1A illustrates a problem identified by the inventors with a conventional container, namely, that the upper surface of the rim of the container is not substantially planar.

In this specification and in the claims that follow, reference will be made to a number of terms which shall be defined to have the following meanings ascribed to them. "Include," "includes," "including," "have," "has," "having," comprise," "comprises," "comprising," or like terms mean encompassing but not limited to, that is, inclusive and not exclusive. The indefinite article "a" or "an" and its corresponding definite article "the" as used in this disclosure means at least one, or one or more, unless specified otherwise. The term "substantially," as used in this document, is a descriptive term that denotes approximation and means "considerable in extent" or "largely but not wholly that which is specified" and is intended to avoid a strict numerical boundary to the specified parameter.

The term "about" means that amounts, sizes, parameters, and other quantities and characteristics are not and need not be exact, but may be approximate and/or larger or smaller, as desired, reflecting tolerances, conversion factors, rounding off, measurement error and the like, and other factors known to those of skill in the art. When a value is described to be about or about equal to a certain number, the value is within ±10% of the number. For example, a value that is about 10 refers to a value between 9 and 11, inclusive. When the term "about" is used in describing a value or an end-point of a range, the disclosure should be understood to include the specific value or end-point. Whether or not a numerical value or end-point of a range in the specification recites "about," the numerical value or end-point of a range is intended to include two embodiments: one modified by "about" and one not modified by "about." It will be further understood that the end-points of each of the ranges are significant both in relation to the other end-point and independently of the other end-point.

The term "about" further references all terms in the range unless otherwise stated. For example, about 1, 2, or 3 is equivalent to about 1, about 2, or about 3, and further comprises from about 1-3, from about 1-2, and from about 2-3. Specific and preferred values disclosed for components, and ranges thereof, are for illustration only; they do not exclude other defined values or other values within defined ranges. The components, methods, and processes of the disclosure include those having any value or any combination of the values, specific values, more specific values, and preferred values described.

Directional terms as used in this disclosure—for example up, down, right, left, front, back, top, bottom—are made only with reference to the figures as drawn and the coordinate axis provided with those figures and are not intended to imply absolute orientation. The coordinate axis illustrated in the figures is a Cartesian coordinate system. A Cartesian coordinate system (X, Y, Z) is a coordinate system that specifies each point uniquely in three-dimensional space by three Cartesian numerical coordinates, which are the signed distances to the point from three, fixed, mutually perpendicular directed lines, measured in the same unit of length. Each reference line is called a coordinate axis or just an axis of the system, and the point where they meet is its origin, usually at ordered triplet (0, 0, 0). The coordinates can also be defined as the positions of the perpendicular projections of the point onto the three axes, expressed as signed distances from the origin.

Reference will now be made in detail to the various exemplary embodiments of the disclosed subject matter, some of which are illustrated in the accompanying figures, in which like reference numerals designate corresponding structure throughout the views. The disclosed structures, methods, and processes can be used to package, store, transport, commercialize, and consume a wide variety of perishable or nonperishable food, liquids, and other products. The disclosed subject matter is particularly suited for extrusion blow molded plastic containers.

Figure 1B:
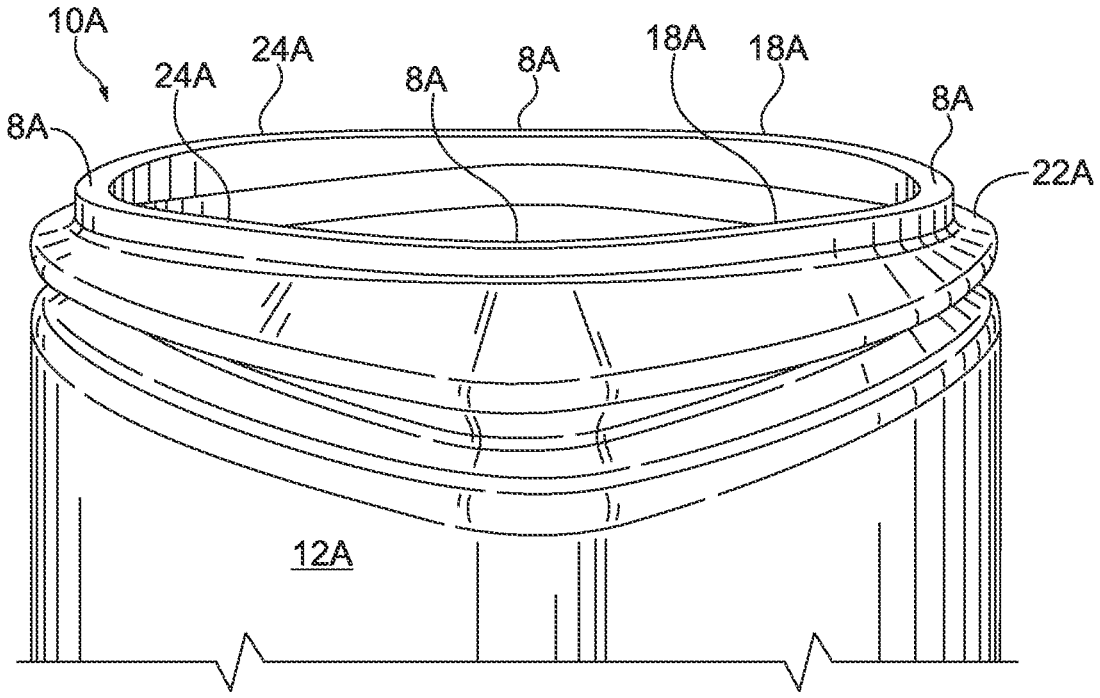
FIG. 1B is a perspective view of the conventional container shown in FIG. 1A.

Various consumer products, such as food products, are packaged for sale in extrusion blow molded plastic containers (i.e., jars, bottles, cans, and the like) that are sealed with a closure. As illustrated in FIG. 1A, one type of such container 10A includes a main body portion 12A and a finish portion 14A that has a circumferentially extending snap bead 22A. The snap bead 22A projects radially outwardly from adjacent areas of the finish portion 14A, and preferably substantially resides within a horizontal plane P that is transverse to a central longitudinal axis L of the container 10A. The finish portion 14A has an upper surface 18A that defines a rim 24A framing an opening that provides access to the hollow interior of the container 10A. FIG. 1B is a perspective view of the conventional container shown in FIG. 1A.

FIGS. 1A and 1B illustrate a problem identified by the inventors with conventional containers such as the container 10A. FIGS. 1A and 1B indicate where there are distinct variations or dips 8A in the upper surface 18A of the rim 24A of the container 10A. Typically, such dips 8A are located proximate the rounded corners of the finish portion 14A. The rim 24A can also have undulations on its top surface that define peaks and valleys. Regardless of the deformity, the rim 24A is not substantially flat and does not lie almost entirely in the horizontal plane P (i.e., the upper surface 18A of the rim 24A is not substantially planar).

Figure 2:
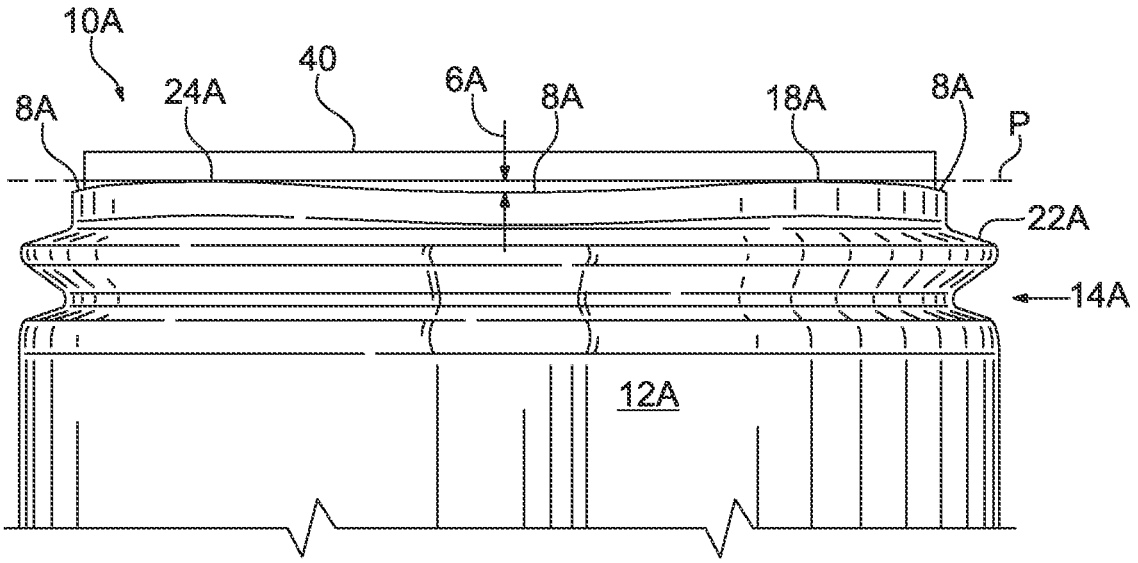
FIG. 2 illustrates one adverse consequence of the lack of planarity discovered for the upper surface of the rim of the container shown in FIGS. 1A and 1B.

FIG. 2 illustrates one adverse consequence of the lack of planarity discovered for the upper surface 18A of the rim 24A of the container 10A. Specifically, when a closure 40 such as a foil seal is applied to the container 10A, the lack of planarity prevents the closure 40 from completely sealing the container 10A. Rather, spaces or gaps 6A exist between the closure 40 and the container 10A in the areas where the dips 8A or valleys exist in the upper surface 18A of the rim 24A. Such sealing issues are not only problematic and undesirable, they are unacceptable. The inventors developed and tested many options but were unable to achieve a manufacturing process for the container 10A that would create a substantially planar upper surface 18A of the rim 24A of the container 10A.

Figure 3:
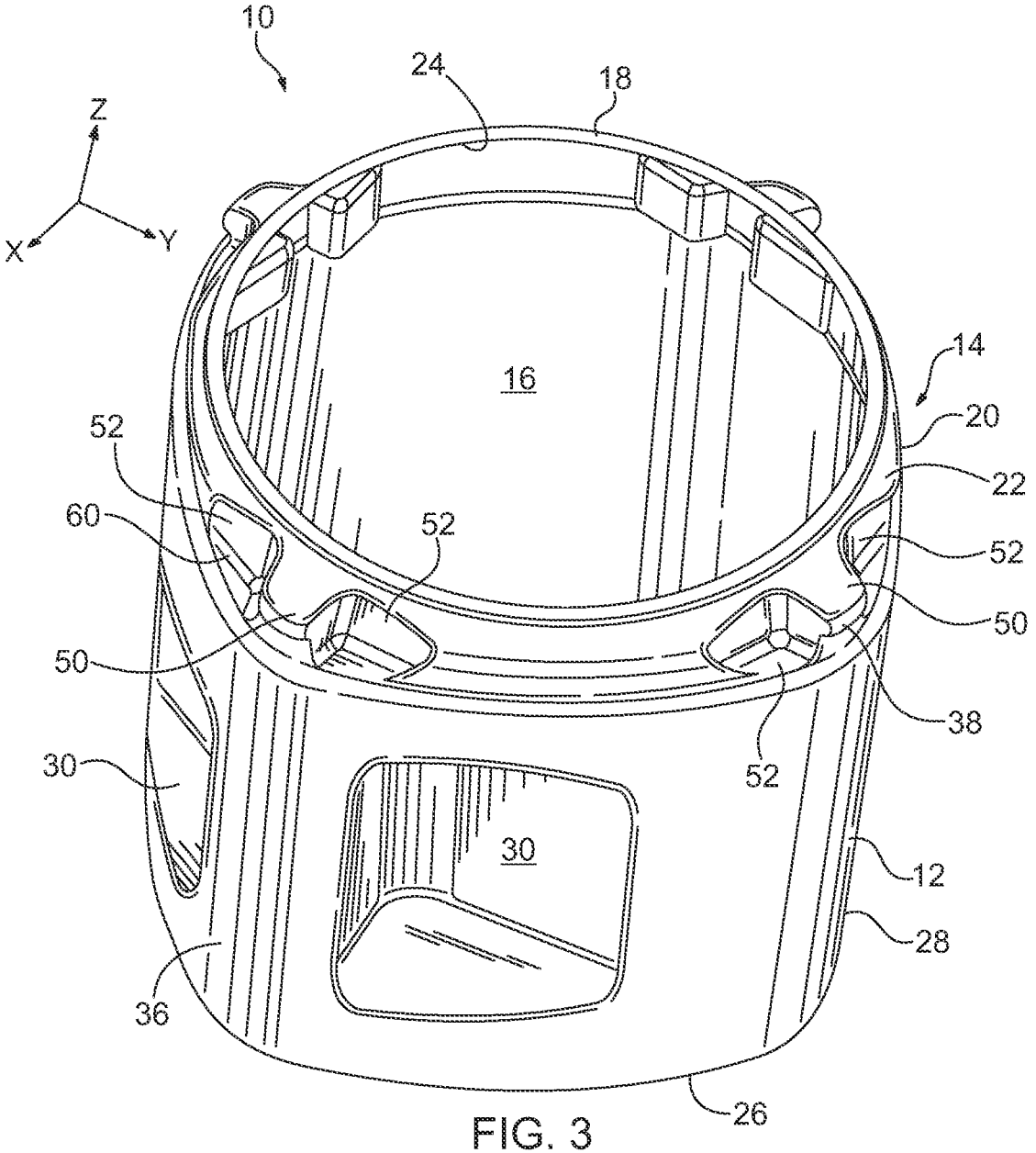
FIG. 3 is a perspective view of a container that has a planar upper surface of the rim and solves the problem exhibited by the container shown in FIGS. 1A, 1B, and 2.

The container 10 as illustrated in FIG. 3 solved the problem. As illustrated in the perspective view of FIG. 3, the container 10 includes a main body portion 12 and a finish portion 14 that has a circumferentially extending snap bead 22. The snap bead 22 projects radially outwardly from adjacent areas of the finish portion 14, and preferably substantially resides within a horizontal plane that is transverse to a central longitudinal axis L of the container 10. The finish portion 14 has an upper surface 18 that defines a rim 24 framing an opening 16 that provides access to the hollow interior of the container 10.

The main body portion 12 has an outer surface 28 that defines a substantially square shape with rounded corners 36 when viewed in transverse cross-section. The finish portion 14 has an outer surface 20 that defines a substantially square shape with rounded corners 38 when viewed in transverse cross-section. The shape of the finish portion 14 when viewed in transverse cross-section is smaller than the shape of the main body portion 12. The container 10 has a substantially flat bottom 26 enabling the container 10 to be supported by a variety of surfaces, such as pallets, shelves, countertops, and the like.

On the outer surface 28, the main body portion 12 may have a side feature 30. The side feature 30 can have many forms and functions. For example, the side feature 30 may form a grip or handle that enables a user to better grasp and manipulate the container 10. The side feature 30 may be a label or graphic that displays information to the user. The side feature 30 also may accommodate internal vacuum forces. Plastic containers, especially blow molded plastic containers, are manufactured in various shapes to achieve structural advantages and aesthetic function. Specifically, it is known to provide container side walls with troughs, extensions, and decorative shapes to accommodate internal vacuum forces.

Most importantly, as illustrated in FIG. 3, portions of the snap bead 22 are removed (i.e., the snap bead 22 is interrupted) to produce the container 10. Such removal leaves a plurality of struts 50 around the circumference of the rim 24. Each strut 50 is bounded by and centered between a pair of strut indents 52. Each indent 52 is formed and supported by a buttress 60 in the rim 24 of the container 10. As defined in greater detail below, each buttress 60 has a vertical leg 54 extending in the Z-direction, a first horizontal leg 56 extending in the Y-direction, and a second horizontal leg 58 extending in the X-direction. The struts 50 and their corresponding strut indents 52 can also function to facilitate the user grasping or holding the container 10. In addition, the struts 50 can incorporate finger texture to further facilitate that function.

Figure 4:
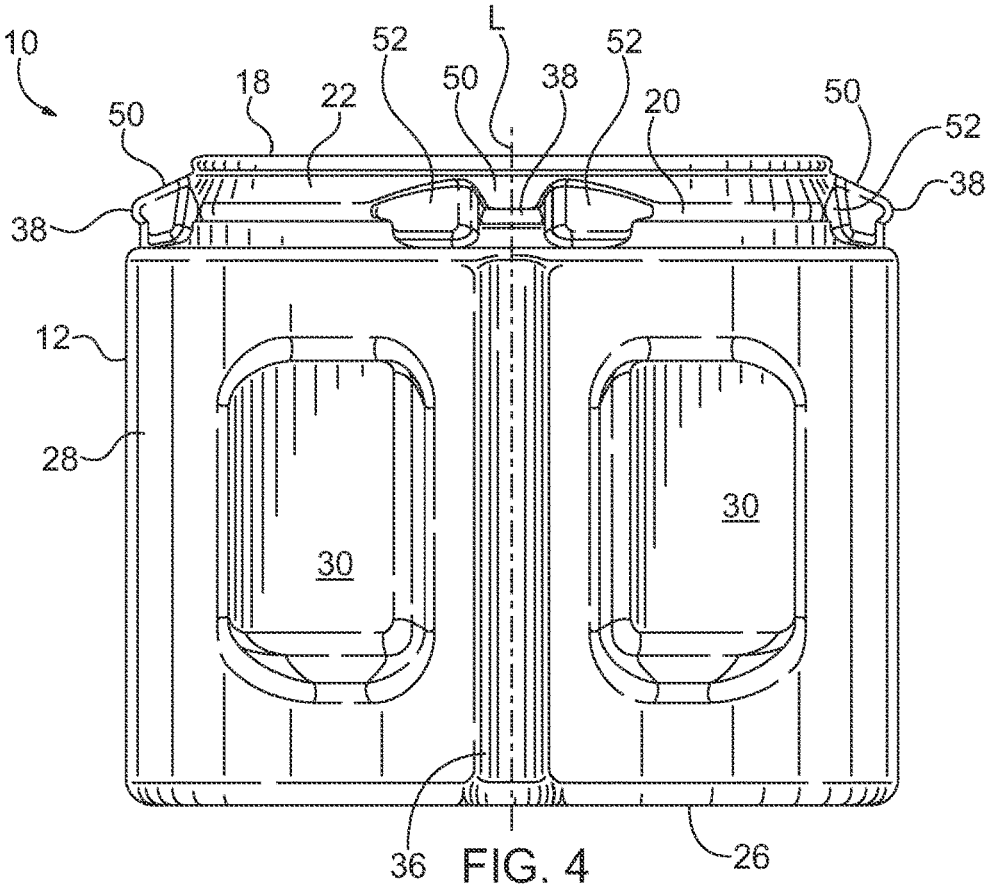
FIG. 4 is a front view of the container shown in FIG. 3.
Figure 5:
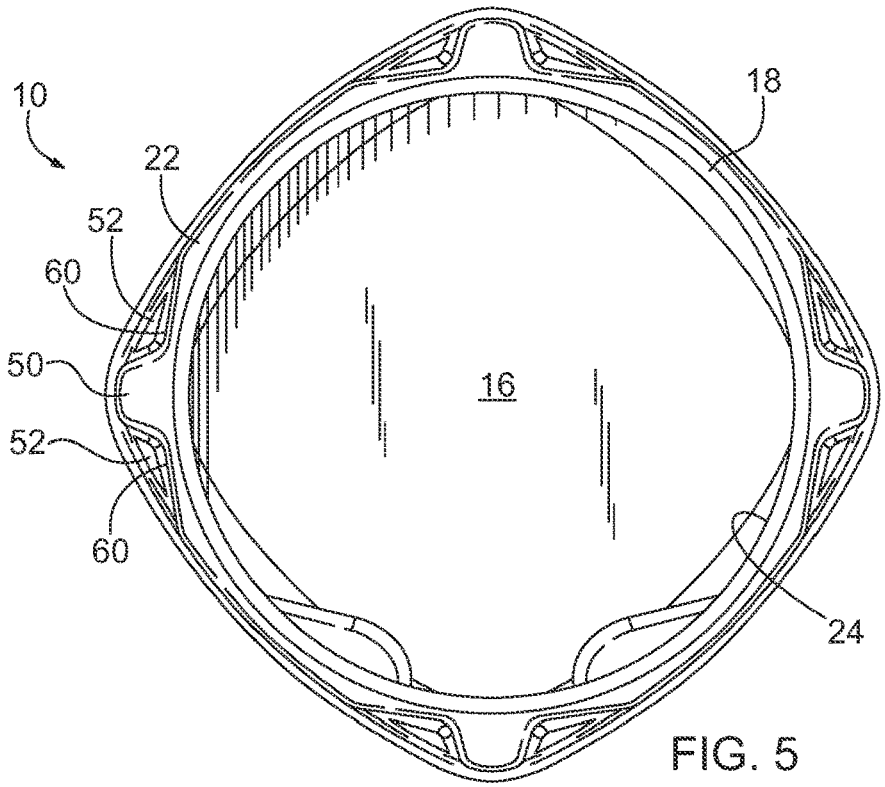
FIG. 5 is a top view of the container shown in FIGS. 3 and 4.

FIG. 4 is a front view of the container shown in FIG. 3. FIG. 5 is a top view of the container shown in FIGS. 3 and 4. As best illustrated in FIG. 4, the container 10 has a substantially planar upper surface 18 of the rim 24. As best illustrated in FIG. 5, the buttresses 60 located in the rim 24 of the container 10 help the upper surface 18 to retain its substantial planarity.

The buttresses 60 strengthen the container 10, assuring the substantial planarity of the upper surface 18 even when the container 10 is subject to significant forces, despite the removal of material from the snap bead 22 to form the struts 50 and indents 52. A buttress is a structure built against another structure in order to strengthen or support it. More precisely, the term "buttress" is an engineering term used to describe a large structural support mass which holds up an adjacent structure by taking some of the load from the adjacent structure. Historically, buttresses have been used to strengthen large walls in buildings such as churches. Any type of buttress will transfer the weight from the walls onto a solid pillar. Flying buttresses consist of an inclined beam carried on a "flying" half arch that projects from the walls of a structure to a pier which supports the weight and horizontal thrust of a roof, dome, or vault. This thrust is carried by the flying buttress away from the building and down the pier to the ground. The buttresses 60 strengthen the container 10 in a similar way.

Figure 6:
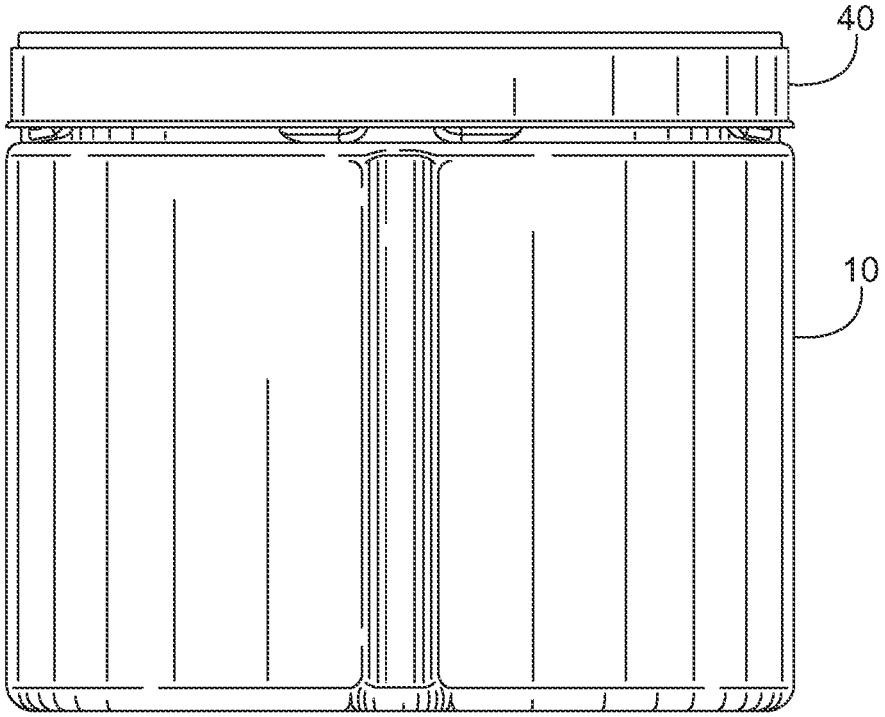
FIG. 6 is a rear view illustrating the container shown in FIGS. 3-5 engaging a closure.

FIG. 6 is a rear view illustrating the container 10 engaging a closure 40. The container 10 has a substantially planar upper surface 18 of the rim 24, assured because the buttresses 60 located in the rim 24 of the container 10 help the upper surface 18 to retain its substantial planarity. Therefore, the rim 24 is devoid of undulations or dips 8A and the closure 40 can easily be applied to the container 10 without issues for mass quantities in production. Accordingly, containers 10 according to the disclosed subject matter can exhibit reduced undesirable or uncontrolled deformation compared to traditional containers having the same sidewall thickness and material weight without compromising performance.

The closure 40 used to seal (i.e., prevent, at least temporarily, access to the hollow interior of the container 10) the container 10 may be any one of a variety of different types of closures. In general, dispensing closures work well for products that are typically used in measured amounts; non-dispensing closures work better for beverages or more viscous liquids. Dispensing closures include (1) the disc top cap, which is an injected molded dispensing closure that will reveal an orifice when pressure is added to the top of the bottle cap (this type of cap is usually applied to cosmetic containers); (2) fine mist sprayers are excellent bottle closures for beauty products with spray applications, for example perfumes, essential oils, hair care products, and spray suntan products; (3) droppers typically have a plastic bulb and a glass pipette that can extend into the container such that, when a user squeezes the plastic bulb, the product (e.g., essential oils, fragrances, and cosmetics) will be drawn into the pipette and can be dispensed as desired; (4) orifice reducers can help control the flow of liquid products, bringing practicality and reliability to the container, and are ideal for dispensing inks, dyes, food colorings, hot sauces, and other liquids; (5) dispensing pumps are ideal for liquid products because they allow liquid to be evenly dispensed with each stroke of the pump; (6) the pail lid available from Reike Packaging Systems of Auburn, Ind. has a spout for dispensing product and is ideal for liquid and viscous products; (7) a sifter fitment is usually a plastic or metal disc that snaps over the bead or rim of a container and is ideal for dispensing spices, herbs, and seasoning products when shaken because it can dispense the right amount of product; (8) the snap top cap has an orifice with a hinged lid to prevent leakage and is ideal both for foods like honey, syrups, sauces, condiments, and the like and for health and beauty products such as essential oils, lotions, shampoos, bath soaps, gels, body washes, etc.; (9) trigger sprayers are usually made from polypropylene (PP) plastic and have a nozzle that can be adjusted to create a fine spray, jet stream, or mist for dispensing liquids such as water, cleaning solutions, or chemicals; and (10) twist top caps will reveal an orifice when the top is twisted, are widely applied on glue containers, and are ideal for dispensing viscous products such as lotions and condiments.

Non-dispensing closures include (1) a continuous thread cap which is a metal or plastic closure that may have different liner options and features threads that wrap continuously around a given finish; (2) lug caps are also called twist off caps and are compatible with containers whose threads are non-continuous; (3) dome caps have a rounded top surface, feature a sleek appearance, and are often used in conjunction with round bottom jars; (4) unlike the Reike pail lid with a spout for dispensing, a pail lid is a HDPE closure that has a sealing gasket; (5) phenolic caps feature a LDPE cone (polycone) that seals the inside diameter of a given container and are ideal for essential oils, chemicals, and other aggressive products; (6) ribbed closures have vertical grooves around the outside edge so end users can remove the closure more easily (this ribbing style is often seen on plastic caps, for example, lotion pumps and snap-top caps); and (7) the opposite of a ribbed closure, a smooth closure has no grooves around the outside edge and can be lotion pumps, snap top caps, flip top caps, and standard, non-dispensing plastic caps.

The closure 40 may include a cap or lid or dropper, as described above, either alone or in combination with an inner seal. Preferably, the closure 40 is a foil or plastic film seal applied to the upper surface 18 of the rim 24 of the container 10 by conduction sealing. Conduction sealing has been a reliable and prevalent method, used by manufacturers for decades, of sealing a liner to a non-screw cap or cap-less container. A conduction hot-plate applies pressure pushing the foil or plastic film seal or liner onto the container and melts the layer on the under surface to create a closure. The conduction "hot-plate" is relatively intolerant of container height and rim variations, however, so containers that are out of specification (e.g., lack rim planarity) may not seal or may have poor seals, creating scrap and waste. Should a spillage occur, clean-up is difficult because spillages often "bake on" requiring shutdown, cooling down time, and cleaning—causing a substantial reduction in production output. The planarity assured by the container 10 avoids these disadvantages of conduction sealing and helps to create a substantially 100% hermetic seal.

Induction cap sealing offers many benefits compared to conduction sealing. Among those benefits are that induction sealing equipment is safer and easier to install, uses a fraction of the energy, is more tolerant of container height variance and lack of planarity, requires less maintenance, is easier to check for seal strength, creates no rise in ambient temperature, and offers improved operator safety. Induction sealing is a non-contact heating process that welds a foil laminate (i.e., the inner seal) to the upper surface 18 of the rim 24 of the container 10. The sealing process takes place after the filling and capping operation. Capped containers pass under an induction cap sealer mounted over a conveyor. The federal Food and Drug Administration recognizes induction sealing as an effective type of tamper evidence.

The standard induction sealing system has two main components: a power supply and a sealing head. The power supply is an electrical generator operating at medium to high frequencies. The sealing head is a plastic case that houses a conductor formed into a (inductive) coil. When energized by the power supply, the head produces an electromagnetic current, called an eddy current. When capped, the container 10 enters this electromagnetic current and the foil of the inner seal generates electrical resistance, heating the foil. The hot foil in turn melts the polymer coating on the inner seal. The heat, coupled with the pressure of the cap, causes the inner seal to bond to the rim 24 of the container 10. The result is a hermetic, leak-proof, and tamper-evident seal. Therefore, using an induction sealing system is ideal for extending product shelf life, preserving freshness, preventing costly leaks, and enhancing the value of a product. When necessary, the inner seals are very tenacious, forcing a user to destroy them to reach the contents in the container 10. In other cases the inner seals are easily peeled.

Which inner seal is most suited for a particular container 10 and product depends on several variables. The inner seal chosen also depends on the application, and there are several combinations of inner seal materials, including foam-backed and paper-backed foil laminates. The inner seals may also include custom-printed logos, trademarks, or other messages, such as "sealed for freshness."

Figure 7:
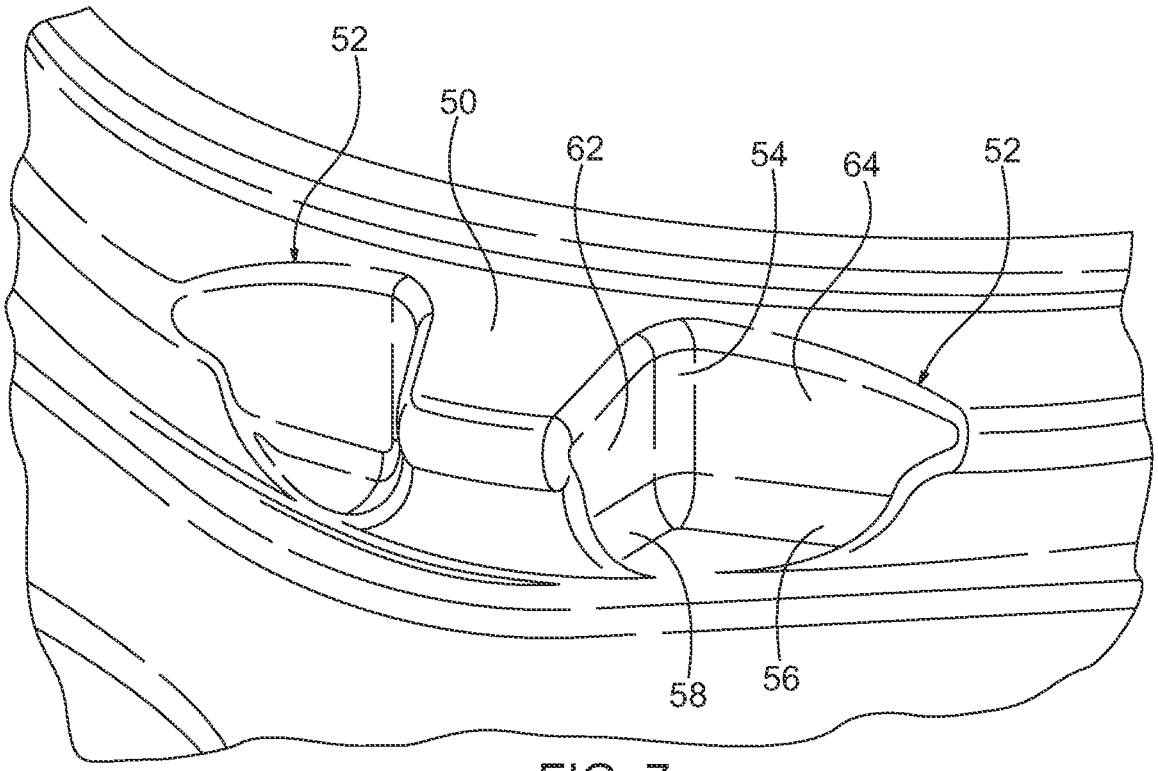
FIG. 7 is a perspective, cutaway view highlighting the strut of the container as bounded by and centered between a pair of strut indents.

FIG. 7 is a perspective, cutaway view highlighting the strut 50 as bounded by and centered between a pair of strut indents 52. Each indent 52 is formed and supported by the buttress 60, which includes the vertical leg 54, the first horizontal leg 56, and the second horizontal leg 58. Each indent 52 has a first side wall 62, which forms a common side wall with the strut 50, and a second side wall 64, which does not form a common side wall with the strut 50.

Figure 8:
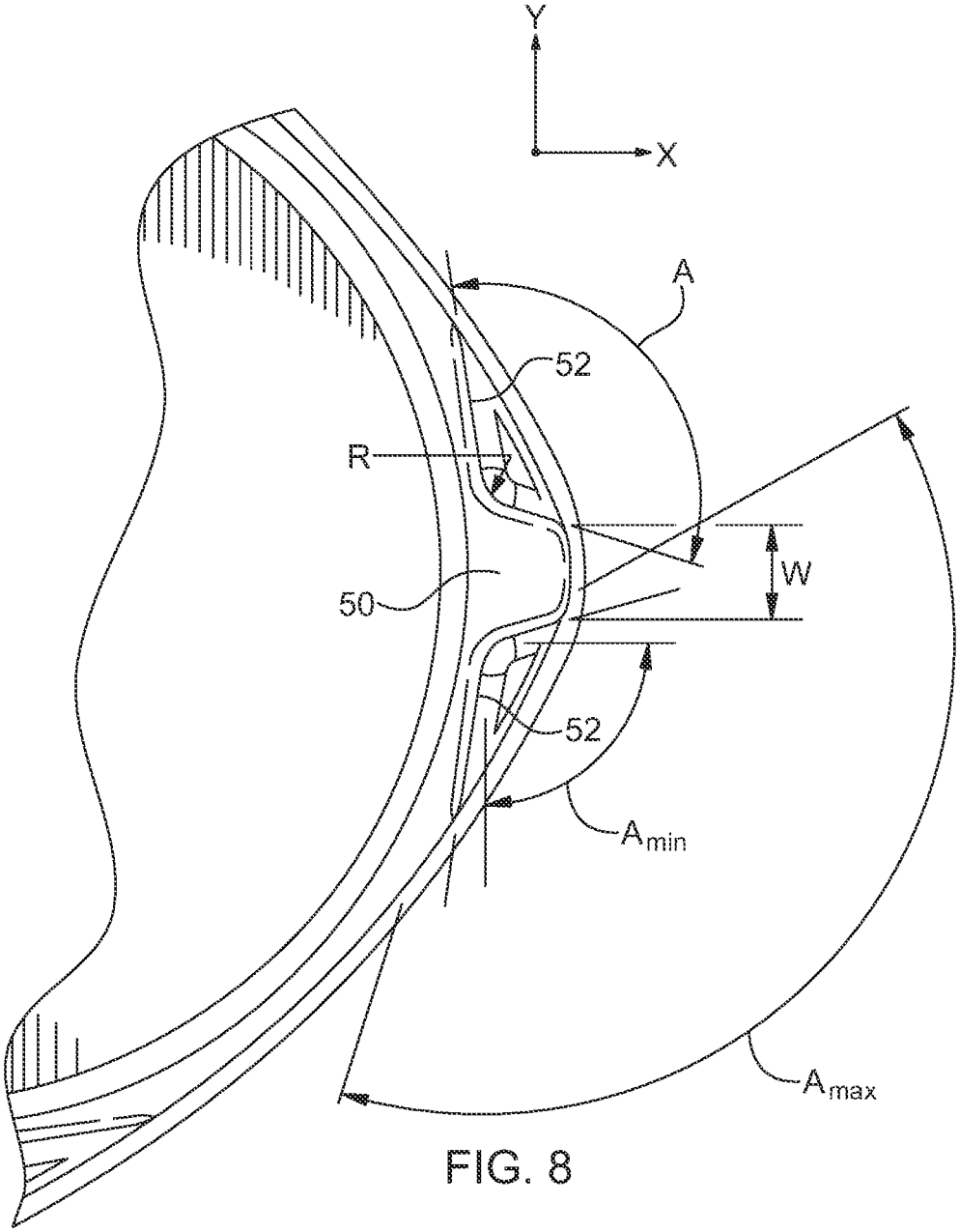
FIG. 8 is a top, cutaway view of the strut as bounded by and centered between the strut indents, highlighting geometrical features for the strut and strut indents.

FIG. 8 is a top, cutaway view highlighting the strut 50 as bounded by and centered between the strut indents 52, highlighting geometrical features for the strut 50 and strut indents 52. As illustrated in FIG. 8, the preferred angle "A" of the strut indent 52 is about 114 degrees. The minimum angle $A_{min}$ of the strut indent 52 is about 90 degrees and the maximum angle $A_{max}$ of the strut indent 52 is about 137 degrees. Thus, the angle A of the strut indent 52 preferably ranges from about 90 degrees to about 137 degrees, more preferably from about 100 degrees to about 125 degrees, and most preferably from about 110 degrees to about 120 degrees.

As further illustrated in FIG. 8, the preferred inner radius "R" of the inside corner between the strut 50 and the strut indent 52 is about 4 mm. The minimum inner radius R is about 2 mm and the maximum inner radius R is about 10 mm. Thus, the inner radius R of the inside corner preferably ranges from about 2 mm to about 10 mm, more preferably from about 3 mm to about 7 mm, and most preferably from about 3.5 mm to about 5 mm. The larger the inner radius R, the more the strut indent 52 must move inward toward the center of the container 10 to reinforce the rim 24.

As still further illustrated in FIG. 8, the preferred width "W" of the strut 50 is about 12 mm. The minimum width W is about 6 mm and the maximum width W is about 18 mm. Thus, the width W of the strut 50 preferably ranges from about 6 mm to about 18 mm, more preferably from about 8 mm to about 16 mm, and most preferably from about 10 mm to about 14 mm. The angle A of the strut indent 52 can be maintained while the width W of the strut 50 is made narrower or broader (i.e., decreasing or increasing W). Therefore, the width W can range from 6 mm to 18 mm while maintaining the preferred angle A.

Figure 9:
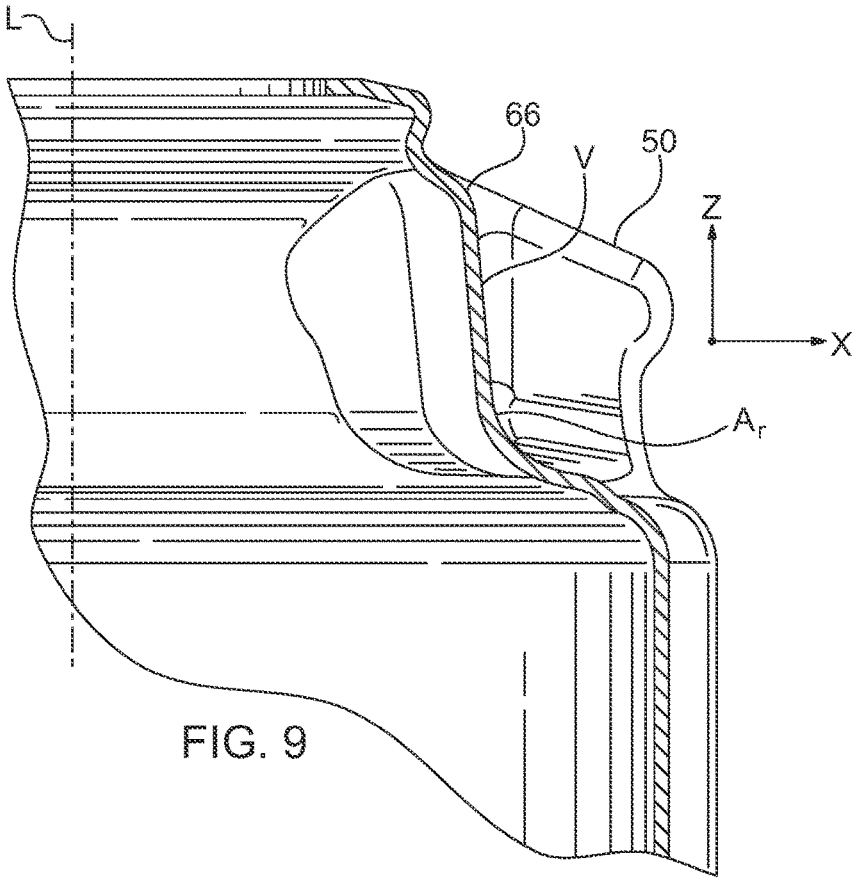
FIG. 9 is a cross section through the strut, helpful to further define the geometry of the strut.

FIG. 9 is a cross section through the strut 50, helpful to further define the geometry of the strut 50. The rear wall 66 of the strut 50 is shown in a dashed contour line having a substantially vertical portion V and an arc radius $A_r$. The substantially vertical portion V forms a preferred angle with the vertical axis Z of about 95 degrees. The minimum angle for the substantially vertical portion V from the vertical is about 90 degrees and the maximum angle is about 106 degrees. Thus, the angle for the substantially vertical portion V from the vertical preferably ranges from about 90 degrees to about 106 degrees, more preferably from about 92 degrees to about 100 degrees, and most preferably from about 93 degrees to about 97 degrees.

The preferred arc radius $A_r$ is about 4.2 mm. The minimum arc radius $A_r$ is about 1 mm and the maximum arc radius $A_r$ is about 8 mm. Thus, the arc radius $A_r$ of the strut 50 preferably ranges from about 1 mm to about 8 mm, more preferably from about 2 mm to about 6 mm, and most preferably from about 3 mm to about 5 mm.

Figure 10:
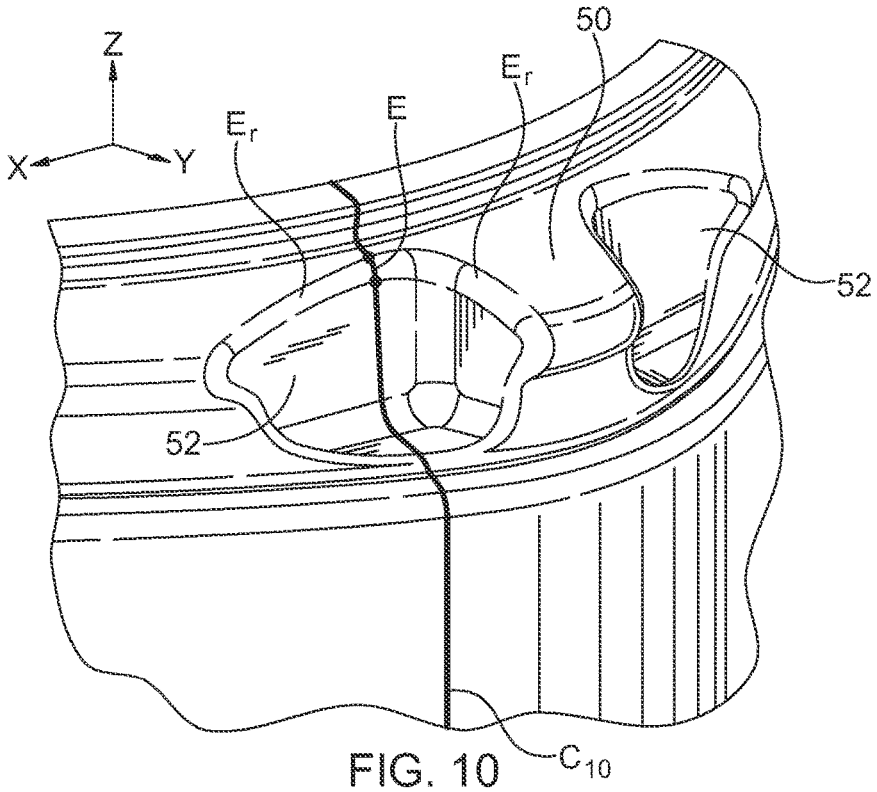
FIG. 10 is a perspective, cutaway view highlighting the strut indent, helpful to further define the geometry of the strut indent.

FIG. 10 a perspective, cutaway view highlighting the strut indent 52. As shown in FIG. 10, the strut indent 52 has an edge E defined between the two dots illustrated on a contour line $C_{10}$. The edge E has an edge radius $E_r$. The preferred edge radius $E_r$ is about 2.25 mm. The minimum edge radius $E_r$ is about 1 mm and the maximum edge radius $E_r$ is about 4 mm. Thus, the edge radius $E_r$ of the inside corner preferably ranges from about 1 mm to about 4 mm, more preferably from about 1.5 mm to about 3 mm, and most preferably from about 2 mm to about 2.5 mm.

Figure 11:
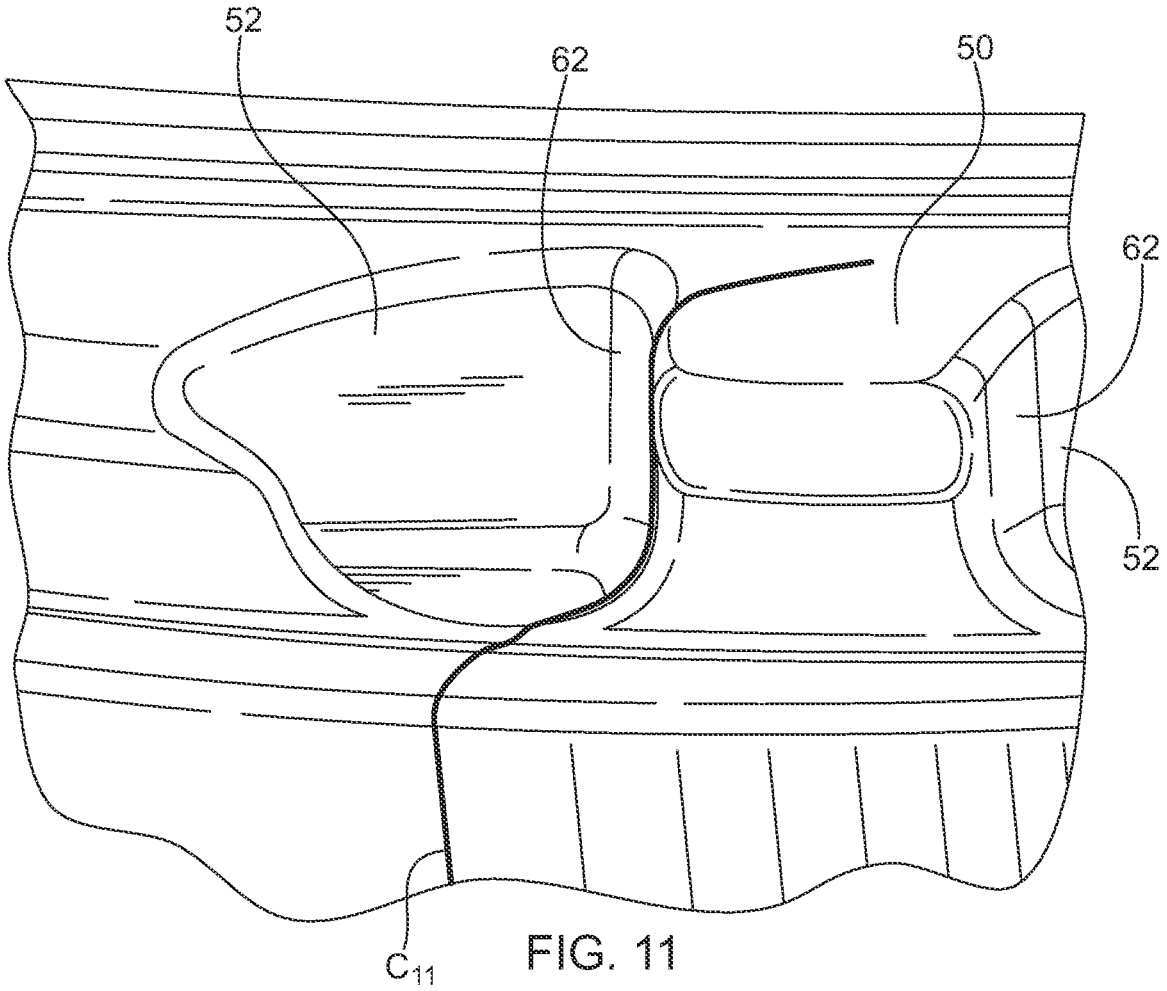
FIG. 11 is a front view highlighting the strut and one of the corresponding strut indents.

FIG. 11 is a front view highlighting the strut 50 and one of the corresponding strut indents 52. A contour line $C_{11}$ depicts the substantially vertical side walls 62 of the strut 50. The side walls 62 form a preferred angle with the vertical axis Z of about 91 degrees. The minimum angle for the side walls 62 from the vertical is about 90 degrees and the maximum angle is about 100 degrees. Thus, the angle for the side walls 62 from the vertical preferably ranges from about 90 degrees to about 100 degrees, more preferably from about 90 degrees to about 95 degrees, and most preferably from about 90.5 degrees to about 93 degrees.

Each of the dimensions, angles, and other geometric aspects of the container 10 outlined above can be predetermined for a particular application. By "predetermined" is meant determined beforehand, so that the predetermined characteristic must be determined, i.e., chosen or at least known, in advance of some event (i.e., manufacture of the container 10).

In summary, the container 10 includes as its main components the hollow plastic main body portion 12 and the integral finish portion 14 with the rim 24 and the radially outwardly extending snap bead 22 for retaining the closure 40 on the finish portion 14. Reinforcement is provided by the integral strut 50 and the integral strut indents 52 with their buttresses 60 on the finish portion 14. Such reinforcement achieves many advantages, including (i) assuring substantial planarity of the upper surface 18 of the rim 24 despite substantial forces acting on the container 10; (ii) maximizing seal integrity and enhancing security of the contents stored in the container 10; and (iii) preventing collapse of the finish portion 14 when the closure 40 is applied to the finish portion 14. The reinforcement preferably is disposed circumferentially at equal angular spacing. All of the components of the container 10 are integrally formed, preferably by blow molding the container 10. By "integral" is meant a single piece or a single unitary part that is complete by itself without additional pieces, i.e., the container 10 is of one monolithic piece formed as a unit.

Preferably, the container 10 is extrusion blow molded from high density polyethylene (HDPE). The container 10 can be made from any suitable polymeric materials, however, including but not limited to low and high-density polyethylene, polyethylene terephthalate (PET), polyethylene naphthalate (PEN), PEN blends, polyvinyl chloride, polypropylene, polystyrene, fluorine treated high density polyethylene, post-consumer resin, K-resin, bioplastic, catalytic scavengers, including monolayer-blended scavengers, multi-layer structures, or a mixture, blend, or copolymer thereof. Olefin, also called alkene, is a compound made up of hydrogen and carbon that contains one or more pairs of carbon atoms linked by a double bond. Olefins are examples of unsaturated hydrocarbons (compounds that contain only hydrogen and carbon and at least one double or triple bond). One type of olefin, polypropylene, is often used in manufacturing plastic parts such as the container 10.

PET thermoplastic resins are polyester materials that provide clarity and transparency that are comparable to glass. PET possesses the processing characteristics, chemical and solvent resistance, and high strength and impact resistance that are required for packaging products such as coffee, juice, soft drinks, and water. PET containers are lightweight, inexpensive, and recyclable and can be economically manufactured in large quantities. They will not shatter and create potentially dangerous shards when dropped, as a glass container may. Thus, PET is a particularly preferred material for the container 10.

In accordance with another aspect of the disclosed subject matter, methods of making and processes of using the container 10 of the disclosed subject matter are provided. It will be understood that the container 10 having the various features as disclosed can be made using any suitable technique, including blow molding, extrusion blow molding, single-stage polyethylene terephthalate, two-stage polyethylene terephthalate, etc. For example, and without limitation, the disclosed container 10 can be made by the methods disclosed in U.S. Pat. No. 8,636,944, 8,585,392, 8,632,867, 8,535,599, 8,544,663, and 8,556,621, each of which is incorporated by reference in this document in its entirety.

PET containers have conventionally been manufactured using the stretch blow molding process. This process involves the use of a pre-molded PET preform having a threaded portion and a closed distal end. The preform is first heated and then is longitudinally stretched and subsequently inflated within a mold cavity so that it assumes the desired final shape of the container. As the preform is inflated, it elongates and stretches, taking on the shape of the mold cavity. The polymer solidifies upon contacting the cooler surface of the mold, and the finished hollow container is subsequently ejected from the mold.

Another well-known process for fabricating plastic containers is the extrusion blow molding process, in which a continuously extruded hot plastic tube or parison is captured within a mold and inflated against the inner surfaces of the mold to form a container blank. Flash material is typically trimmed from the container blank after it has been ejected from the mold. In such processes, the mold is typically designed to travel at the speed at which the extruded parison is moving when it closes on the parison so that the process can operate on a continuous basis. There are several different types of extrusion blow molding machines, including shuttle molds that are designed to travel in a linear motion and extrusion blow molding wheels that travel in a rotary or circular motion.

Extrusion blow molding is typically used to form plastic containers, such as motor oil containers, from nontransparent materials such as polyolefin or polyethylene. In the past, it was not typical to use extrusion blow molding to fabricate PET containers, because no commercially available PET material provided the required melt strength for extrusion blow molding in addition to being compatible with standard PET recycling processes. More recently, however, extrudable PET (EPET) materials have been made commercially available that can be processed at temperatures and conditions similar to standard PET and that provide the required melt strength for extrusion blow molding. Such materials have higher melt temperatures than the polyethylene or polyolefin materials that are typically used with extrusion blow molding. A number of containers that are fabricated using extrusion blow molding have now been commercially introduced.

With respect to processes of using the container 10 of the disclosed subject matter, the container 10 can be sealed and cooled using any suitable process. The disclosed technology could be applied to any type of food or agri-chemical package when a user desires uniqueness in shape and form combined with closure sealing integrity.

Figure 12:
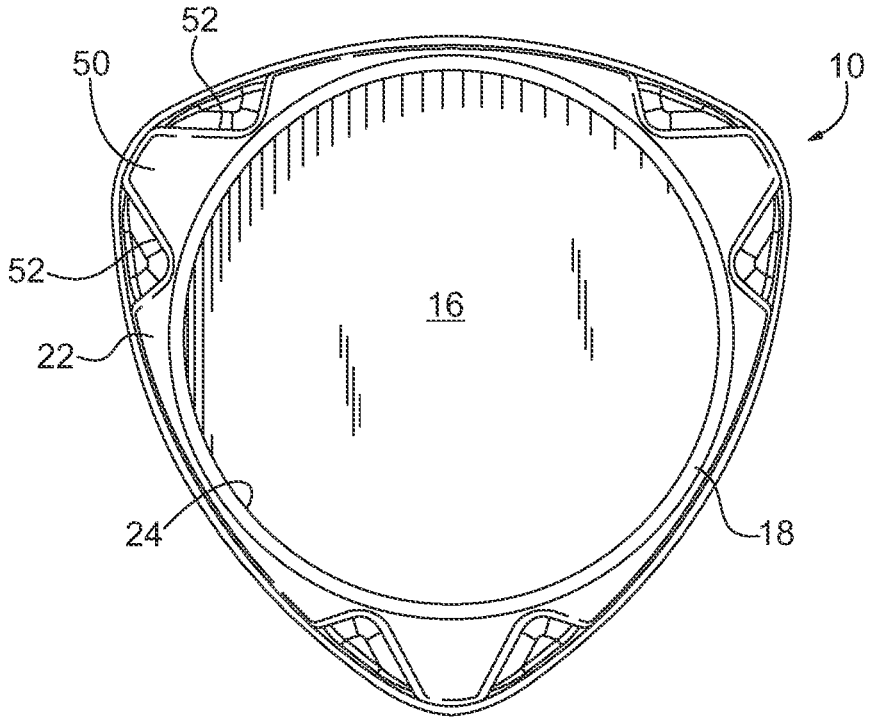
FIG. 12 is a top view of a container having a substantially triangle shaped main body portion.
Figure 13:
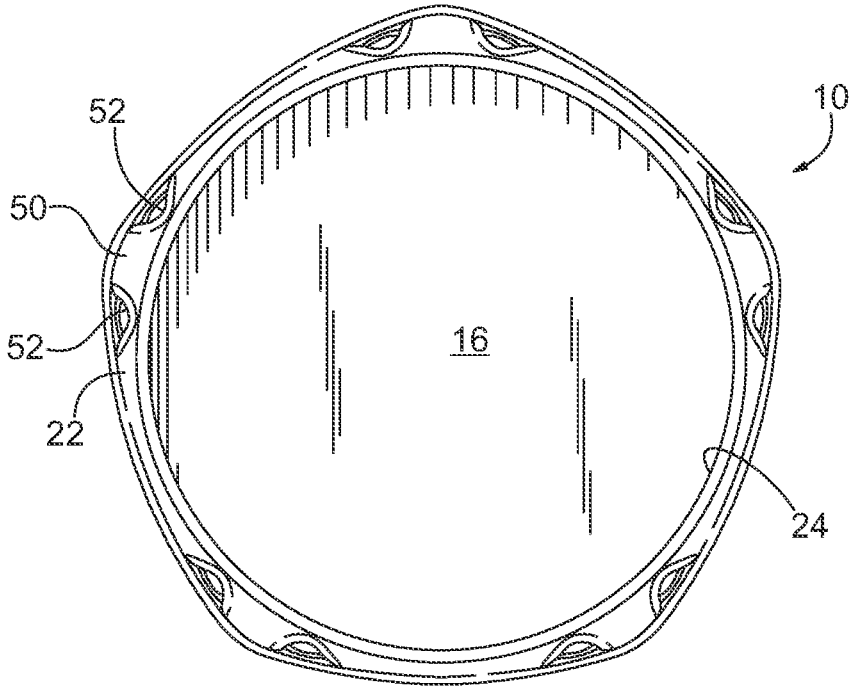
FIG. 13 is a top view of a container having a substantially pentagonal shaped main body portion.
Figure 14:
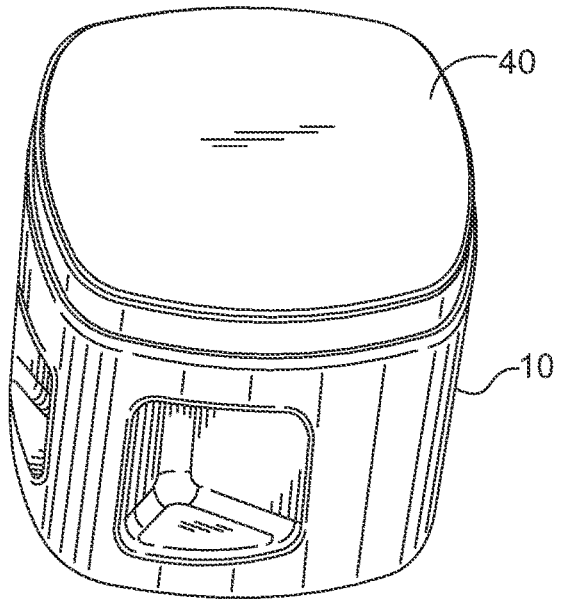
FIG. 14 is a perspective view of the container shown in FIG. 5 with a closure engaging the container.
Figure 15:
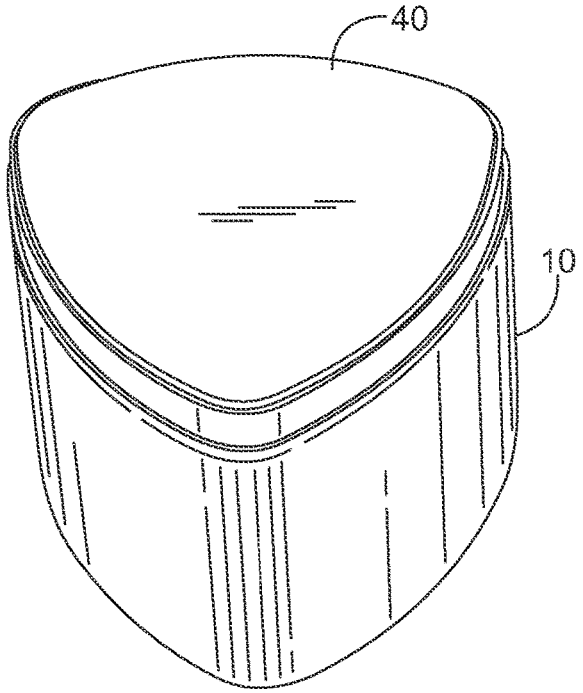
FIG. 15 is a perspective view of the container shown in FIG. 12 with a closure engaging the container.
Figure 16:
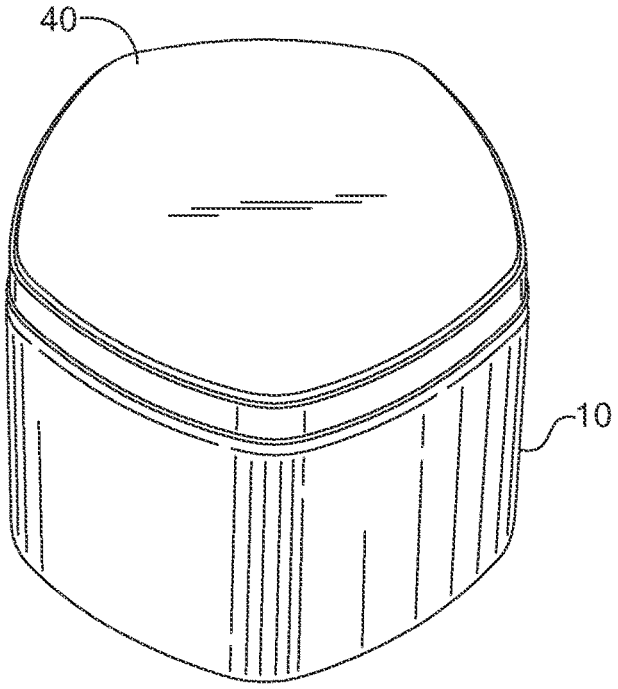
FIG. 16 is a perspective view of the container shown in FIG. 13 with a closure engaging the container.

The finish portion 14 could be incorporated on any free-form shaped container 10 to help facilitate the application of the closure 40 such as a foil seal. The container 10 has a substantially square shaped main body portion 12 in the example illustrated in FIG. 5; a substantially triangle shaped main body portion 12 in the example illustrated in FIG. 12; and a substantially pentagonal shaped main body portion 12 in the example illustrated in FIG. 13. Thus, the shape of the main body portion 12 can vary as long as a substantially round opening 16 is defined by the shape; the substantially round opening 16 facilitates ease of trimming. FIG. 14 is a perspective view of the container 10 shown in FIG. 5 with the closure 40 engaging the container 10; FIG. 15 is a perspective view of the container 10 shown in FIG. 12 with the closure 40 engaging the container 10; and FIG. 16 is a perspective view of the container 10 shown in FIG. 13 with the closure 40 the container 10. In each case, the closure 40 completely covers the opening 16 and, in some cases (specifically, for example, in the case of a conduction foil seal), the closure 40 completely seals the opening 16.

The example embodiment of the strut 50 and strut indents 52 with buttresses 60 is easily molded. These components act as columns of strength which help stabilize the rim 24. Any suitable closure 40 can be applied over the snap bead 22 in the corners without issue. Once the struts 50 and strut indents 52 with buttresses 60 have been added to the container 10, regardless of the shape of the container 10, the structure has shown that it enhances the top load strength of the container 10 thus allowing for light-weighting of the design.

There are no major undercuts (and, in some cases, no undercuts at all) in the way the strut 50 and strut indents 52 with buttresses 60 have been added to the container 10. In the example embodiment shown in FIG. 5 having a square shaped main body portion 12, there are four struts 50, each with a pair of corresponding strut indents 52 (so, a total of eight strut indents 52). One of the struts 50 and pair of strut indents 52 are preferably located in each corner of the square shape. When looking straight on at the strut 50, as in FIG. 4, the left side is mirrored on the right side. Each set of struts 50 and strut indents 52 is then placed evenly around the circumference of the container 10 at 90-degree intervals. There could be various other ways to configure, distribute, and shape the set of struts 50 and strut indents 52, and the sets could be provided in different quantities (other than the four sets shown).

The various embodiments of the disclosed subject matter solve the problem, which is identified above and addressed, by providing a non-round, faceted, or square canister or container 10 which incorporates a circular blow dome with a round planar surface for sealing the container 10. Some users require a square container shape that accommodates a square closure 40. One way to achieve such a design in blow molding is to incorporate a cylindrical trimming surface combined with a square body design. The resulting shape of the chosen design incorporated a round base with a square shoulder with a square locking feature that accepted a square closure with a round opening for easy access to the product. The round trim left some of the complexity out of the process for trimming because, from experience, trimming non-round items will cause gapping issues when applying an inner foil seal. The resulting shape, which was blown and tested, proved to be overly complex because warpage of the rim was observed where the foil seal would be applied. A variety of processing options were tested and the resulting surface caused leaks at the sealing machine. Months were spent trying to fix this issue with other iterations being tooled and tested with the same inferior warped results. Needed were new innovative options to produce a free-form canister or container which maintained a substantially flat or planar sealing surface able to accept an inner foil seal without flaws or issues. It was also necessary for the container to accommodate a tall, square closure when applied to the container.

The container shape transitions from round at the base to a square in the upper section to receive a square closure and then back into a round shape at the rim. Providing this type of geometric transition in a HDPE container is very difficult while achieving a quality design. The top load as well as all of the sizing and manufacturing constraints played a role in shaping the final design. Most other shapes that were square in nature would be very difficult to manage in mass production to maintain a true planarity of the sealing surface.

The solution provided by the disclosed subject matter is relatively simple in nature in that it breaks up the angular surface area of the corners of the container. By doing so, the solution creates a more stable finish which can be repeated again and again without issue. The struts 50 and strut indents 52 can be molded because they have no undercuts and are easy to mold into the design. The bulk of the snap bead 22 remains in place, which also allows for the easy application of the square closure. By breaking up the corner geometry with the application of a negative architectural buttress 60, the solution stabilizes the overall geometry of the rim 24. The final shape is not an issue for the container components and completely solves the problem of a non-planer rim for the container. The result is a complex container shape that has a substantially flat, planar surface for accepting a foil seal with 100% integrity. This rim components could be applied to almost any container shape with high confidence having a high yielding output for mass production.

In summary, the container 10 includes the innovative rim components. One example shape of the container 10 is a round to square to round body which incorporates a series or set of struts 50 and strut indents 52 with buttresses 60 which are applied to opposite sides of each of the four corners in the square upper body portion of the container 10. (Of course, other shapes, such as square to square to round, are also possible.) The overall body shape of the container 10 consists of a round lower base section which transitions or morphs into a square shoulder which then conforms to a round rim and round blow-dome for ease of trimming the container 10. An identical set including the strut 50 and two corresponding strut indents 52 is applied with symmetry at each of the four corners of the container 10, with one strut indent 52 mirroring the other. Any number of these sets could be applied to the container 10 depending on how many corners or facets are built into the shape. The mirrored geometry of the struts 50 and strut indents 52 in the corners is important for the design as well as repetition of the sets in every corner. The result is a solution assuring rim planarity and improved top load strength. This design would work for any non-round, faceted, or square shape for incorporating a foil seal on a container.

Although illustrated and described above with reference to certain specific embodiments and examples, the present disclosure is nevertheless not intended to be limited to the details shown. Rather, various modifications may be made in the details within the scope and range of equivalents of the claims and without departing from the spirit of the disclosure. It is expressly intended, for example, that all ranges broadly recited in this document include within their scope all narrower ranges which fall within the broader ranges.

What is claimed:

1. A plastic container comprising:

a non-round main body portion having a central longitudinal axis and defining a hollow interior of the container; and a finish portion integral with the main body portion and having an upper surface defining a rim with a circumference framing a round opening that provides access to the hollow interior of the container, a snap bead projecting radially outward from adjacent areas of the finish portion, the snap bead being adapted to receive and retain a closure and hermetically seal the container and including interrupted portions located around the circumference of the rim, and a plurality of reinforcements located in the interrupted portions of the snap bead and assuring substantial planarity of the upper surface of the rim even when substantial forces act on the container, wherein each reinforcement comprises a strut bounded by and centered between a pair of strut indents, wherein the strut indents form an angle between about 90 and 137 degrees, with each indent supported by a buttress having a first horizontal leg extending in a first direction, a second horizontal leg extending in a second direction, and a vertical leg extending in a third direction.

2. The plastic container according to claim 1 further comprising a foil or plastic film seal applied to the upper surface of the rim of the container by conduction sealing.

3. The plastic container according to claim 1 wherein the main body portion has an outer surface that defines a substantially square shape with rounded corners when viewed in transverse cross-section and the finish portion has an outer surface that defines a substantially square shape with rounded corners when viewed in transverse cross-section, and the shape of the finish portion is smaller than the shape of the main body portion.

4. The plastic container according to claim 1 wherein the main body portion has an outer surface and a side feature located in or on the outer surface.

5. The plastic container according to claim 1 wherein each indent has a first side wall which forms a common side wall with the strut and a second side wall which does not form a common side wall with the strut.

6. The plastic container according to claim 1 wherein the strut indents form an angle of about 114 degrees.

7. The plastic container according to claim 1 wherein an inside corner having an inner radius is formed between each strut and strut indent, and the inner radius ranges from about 2 mm to about 10 mm.

8. The plastic container according to claim 7 wherein the inner radius is about 4 mm.

9. The plastic container according to claim 1 wherein the strut has a width that ranges from about 6 mm to about 18 mm.

10. The plastic container according to claim 9 wherein the width is about 12 mm.

11. The plastic container according to claim 1 wherein the strut has a rear wall with a substantially vertical portion and an arc radius.

12. The plastic container according to claim 1 wherein each strut indent has an edge with an edge radius, and the edge radius ranges from about 1 mm to about 4 mm.

13. The plastic container according to claim 12 wherein the edge radius is about 2.25 mm.

14. A plastic container comprising:

a non-round main body portion having a central longitudinal axis and defining a hollow interior of the container; and a finish portion integral with the main body portion and having an upper surface defining a rim with a circumference framing a round opening that provides access to the hollow interior of the container, a radially outwardly extending snap bead being adapted to receive and retain a closure and hermetically seal the container and including interrupted portions located around the circumference of the rim, and a plurality of reinforcements located in the interrupted portions of the snap bead and assuring substantial planarity of the upper surface of the rim even when substantial forces act on the container, wherein each reinforcement has a strut bounded by and centered between a pair of strut indents, with each indent supported by a buttress having a first horizontal leg extending in a first direction, a second horizontal leg extending in a second direction, and a vertical leg extending in a third direction, wherein the strut indents form an angle between about 90 and 137 degrees, wherein an inside corner having an inner radius is formed between each strut and strut indent and the inner radius ranges from about 2 mm to about 10 mm, wherein the strut has a width that ranges from about 6 mm to about 18 mm, wherein the strut has a rear wall with a substantially vertical portion and an arc radius, and wherein each strut indent has an edge with an edge radius and the edge radius ranges from about 1 mm to about 4 mm.

15. The plastic container according to claim 14 further comprising a foil or plastic film seal applied to the upper surface of the rim of the container by conduction sealing.

16. The plastic container according to claim 14 wherein the main body portion has an outer surface that defines a substantially square shape with rounded corners when viewed in transverse cross-section and the finish portion has an outer surface that defines a substantially square shape with rounded corners when viewed in transverse cross-section, and the shape of the finish portion is smaller than the shape of the main body portion.

17. The plastic container according to claim 14 wherein the main body portion has an outer surface and a side feature located in or on the outer surface.

18. A plastic container comprising:

a main body portion having a central longitudinal axis and an outer surface that defines a substantially square shape with rounded corners when viewed in transverse cross-section and defining a hollow interior of the container;

a finish portion integral with the main body portion and having an outer surface that defines a substantially square shape with rounded corners when viewed in transverse cross-section, an upper surface defining a rim with a circumference framing a round opening that provides access to the hollow interior of the container, a radially outwardly extending snap bead being adapted to receive and retain a closure and hermetically seal the container and including interrupted portions located around the circumference of the rim, and a plurality of reinforcements located in the interrupted portions of the snap bead and assuring substantial planarity of the upper surface of the rim even when substantial forces act on the container; and a foil or plastic film seal applied to the upper surface of the rim of the container by conduction sealing, wherein the shape of the finish portion is smaller than the shape of the main body portion, wherein each reinforcement has a strut bounded by and centered between a pair of strut indents, with each indent supported by a buttress having a first horizontal leg extending in a first direction, a second horizontal leg extending in a second direction, and a vertical leg extending in a third direction, wherein the strut indents form an angle between about 90 and 137 degrees, wherein an inside corner having an inner radius is formed between each strut and strut indent and the inner radius ranges from about 2 mm to about 10 mm, wherein the strut has a width that ranges from about 6 mm to about 18 mm, wherein the strut has a rear wall with a substantially vertical portion and an arc radius, and wherein each strut indent has an edge with an edge radius and the edge radius ranges from about 1 mm to about 4 mm.

* * * * *